United States Patent [19]

Yukawa et al.

[11] 4,121,930

[45] Oct. 24, 1978

[54] NITROGEN CONTAINING HIGH SPEED STEEL OBTAINED BY POWDER METALLURGICAL PROCESS

[75] Inventors: Toru Yukawa; Nobuyasu Kawai; Katuhiko Honma, all of Kobe; Hirofumi Fujimoto, Ono; Hiroshi Takigawa, Kobe; Minoru Hirono, Kobe; Masaru Ishii, Kobe; Tsuneo Tatsuno, Akashi, all of Japan

[73] Assignee: Kobe Steel, Ltd., Kobe, Japan

[21] Appl. No.: 755,141

Foreign Application Priority Data

Dec. 29, 1975 [JP] Japan ..... 50–155984

[22] Filed: Dec. 29, 1976

[51] Int. Cl.[2] ..... B22F 3/00

[52] U.S. Cl. ..... 75/238; 75/243; 75/123 B; 75/123 H; 75/123 J; 75/123 K; 75/126 R; 75/126 E; 75/126 F; 75/126 P; 75/126 J

[58] Field of Search ..... 75/243, 238, 123 B, 75/123 H, 123 J, 123 K, 126 R, 126 E, 126 F, 126 P, 126 J

[56] References Cited

U.S. PATENT DOCUMENTS

| | | | |
|---|---|---|---|
| 2,805,942 | 9/1957 | Payson | 75/126 J |
| 3,201,232 | 8/1965 | Thier | 75/126 J |
| 3,876,475 | 4/1975 | Ramquist | 75/126 J |

FOREIGN PATENT DOCUMENTS

| | | | |
|---|---|---|---|
| 781,083 | 8/1957 | United Kingdom | 75/226 |

*Primary Examiner*—Brooks H. Hunt

*Attorney, Agent, or Firm*—Oblon, Fisher, Spivak, McClelland & Maier

[57] ABSTRACT

The present invention relates to a nitrogen containing high speed steel obtained by the powder metallurgical process, which comprises at least 0.40% N, 1.6 to 15% V, C in an amount satisfying the relationship of $0.5 + 0.2V\ (\%) \leqq (C + N) \leqq 0.8 + 0.2V\ (\%)$, at least one element selected from the group consisting of up to 15% of Cr, up to 10% of Mo, up to 20% of W and up to 15% of Co with the balance iron.

4 Claims, 4 Drawing Figures

NITROGEN CONTAINING HIGH SPEED STEEL OBTAINED BY POWDER METALLURGICAL PROCESS

BACKGROUND OF THE INVENTION

It is known that properties of high speed steels containing alloy elements such as Cr, W and V can be improved by incorporation of nitrogen into the steels (see, for example, Kobe Steel Technical Bulletin, R & D, Vol. 24, No. 3, pages 11 to 15, and Japanese Patent Application Laid-Open Specifications No. 78606/74, No. 49109/75 and No. 49156/75). By the nitriding treatment, a nitride of the type MX or $M_6X$ (in which M stands for an alloy element and X stands for carbon or nitrogen) is formed, and this nitride is more stable than a carbide of the MC or $M_6C$ type. Accordingly, the appropriate quenching temperature range is broadened and control of the heat treatment can be facilitated. Further, the temper hardening characteristic is improved and a finer austenite crystal structure can be obtained to improve the mechanical properties. Furthermore, the machinability of the steel can be improved. It is construed that by virtue of these effects, the properties of such high speed steels can be improved by incorporation of nitrogen into the steels.

Most conventional nitrogen containing high speed steels have heretofore been prepared by the smelting process. When the smelting process is adopted for production of nitrogen containing high speed steels, it is necessary to perform complicated steps such as the step of melting steel in a high pressure nitrogen atmosphere or the step of throwing a nitride into molten steel. Further, according to the smelting process, since the amount of nitrogen included in steel is small and it is difficult to form a fine carbonitride and distribute it uniformly in steel, it is impossible to improve the properties to desirable levels.

As a means of overcoming the defects or limitations involved in the smelting process, methods have recently been proposed for obtaining nitrogen containing high speed steels by the powder metallurgical process or the powder forging process. In these methods, by utilizing the fact that powder has a large specific surface area and the fact that a powder sintered body has a porous structure, an optional amount of nitrogen can be included in steel by a simple means, for example, by adding nitrogen in advance to the starting powder or adjusting the heating temperature, the heating time or the nitrogen partial pressure in the treatment atmosphere at the sintering step. It is expected that nitrogen will be finely and uniformly distributed in steels according to these methods.

In conventional nitrogen containing high speed steels obtained by the powder metallurgical process, the machinability is not as highly improved as might be expected. Rather, the machinability is degraded by incorporation of nitrogen into the steel. Accordingly, it is often said that the value of nitrogen containing high speed steels obtained by the powder metallurgical process is questionable. Moreover, several nitrogen containing high speed steels obtained by the powder metallurgical process, which have recently been put into practical use, have exhibited good machinability and good wear resistance in combination. The reason for this has not been elucidated. In particular the relation between amounts of alloy elements which impart excellent machinability to steels and the amount of nitrogen enrichment is not clarified. Therefore, the kinds of steels which are enriched with nitrogen for the production of high speed steels by the powder metallurgical process and which are applicable are drastically limited. For example, Kobe Steel Technical Bulletin, R & D, Vol. 24, No. 3, page 10 discloses that when 0.4 to 0.5% of nitrogen is added to Mo type high speed steels (JIS SKH 9 and modified JIS SKH 55) by the powder metallurgical process, the machinability is remarkably improved. Indeed, improved machinability can be attained by such technique. However, the addition of such a large amount of nitrogen to high speed steels in which the contents of alloy elements are standarized results in disorder of the stoichiometric balance among alloy elements in high speed steels. Therefore, various problems are caused by this technique. For example, the residual austenite content at the quenching step is increased and it is necessary to increase the number of repetitive tempering steps. Accordingly, the size change during heat treatment is enhanced. Moreover, the toughness is degraded and the applicable range of cutting tools of these steels is considerably limited.

The above advantage of the powder metallurgical process in that an optional amount of nitrogen can be included into steel and a fine carbonitride can be distributed uniformly in the steel was observed and consequently research was conducted with a view to improving various properties of high speed steels, especially the machinability, by nitrogen enrichment of high speed steels comprising various alloy components according to the powder metallurgical process. As a result, we found that in order to improve the machinability without degradation of heat treatment characteristics and mechanical properties of high speed steels, a specific relationship must be established among C, N and V as specific ingredients of high speed steels. The present invention has been completed based on this finding.

SUMMARY OF THE INVENTION

The objective of the present invention is to solve problems involved with conventional nitrogen containing high speed steels obtained by the powder metallurgical process. It is therefore a primary object of the present invention to provide a nitrogen containing high speed steel obtained by the powder metallurgical process in which the machinability is improved without degradation of the heat treatment characteristic and traverse bending strength.

In accordance with the first aspect of the present invention in which the above and other objects are attained a nitrogen containing high speed steel obtained by the powder metallurgical process is provided which comprises at least 0.40% of N, 1.6 to 15% of V, C in an amount satisfying the relation of $0.5 + 0.2V\ (\%) \leqq (C + N) \leqq 0.8 + 0.2V\ (\%)$ and at least one member selected from the group consisting of up to 15% of Cr, up to 10% of Mo, up to 20% of W and up to 15% of Co with the balance iron and the inevitable impurities.

In accordance with the second aspect of the present invention, a nitrogen containing high speed steel as set forth in the first aspect is provided wherein the content of N is at least 0.45%.

In accordance with the third aspect of the present invention, a nitrogen containing high speed steel as set forth in the first and second aspects is provided wherein the content of V is 2.5 to 15%.

In accordance with the fourth aspect of the present invention, a nitrogen containing high speed steel as set forth in the first, second and third aspects is provided which further comprises at least one member selected from the group consisting of up to 2% of Zr, up to 5% of Nb and up to 1% of B.

DETAILED DESCRIPTION OF THE PREFERRED EMBODIMENTS

The nitrogen containing high speed steels obtained by the powder metallurgical process according to the present invention will now be described in detail by reference to the accompanying drawings.

A typical example of a steel powder heretofore used for production of nitrogen containing high speed steels by the powder metallurgical process, is a powder of a steel corresponding to JIS SKH (comprising 0.8% of C, 4.1% of Cr, 5.2% of Mo, 6.2% of W and 2.01% of V) Nitrogen was incorporated in this steel and high speed steels differing in the nitrogen content were prepared. In these high speed steels, the influence of the nitrogen content on the machinability, the size change during heat treatment and the traverse bending strength were examined and the results shown in FIG. 1 were obtained.

Figure 1:
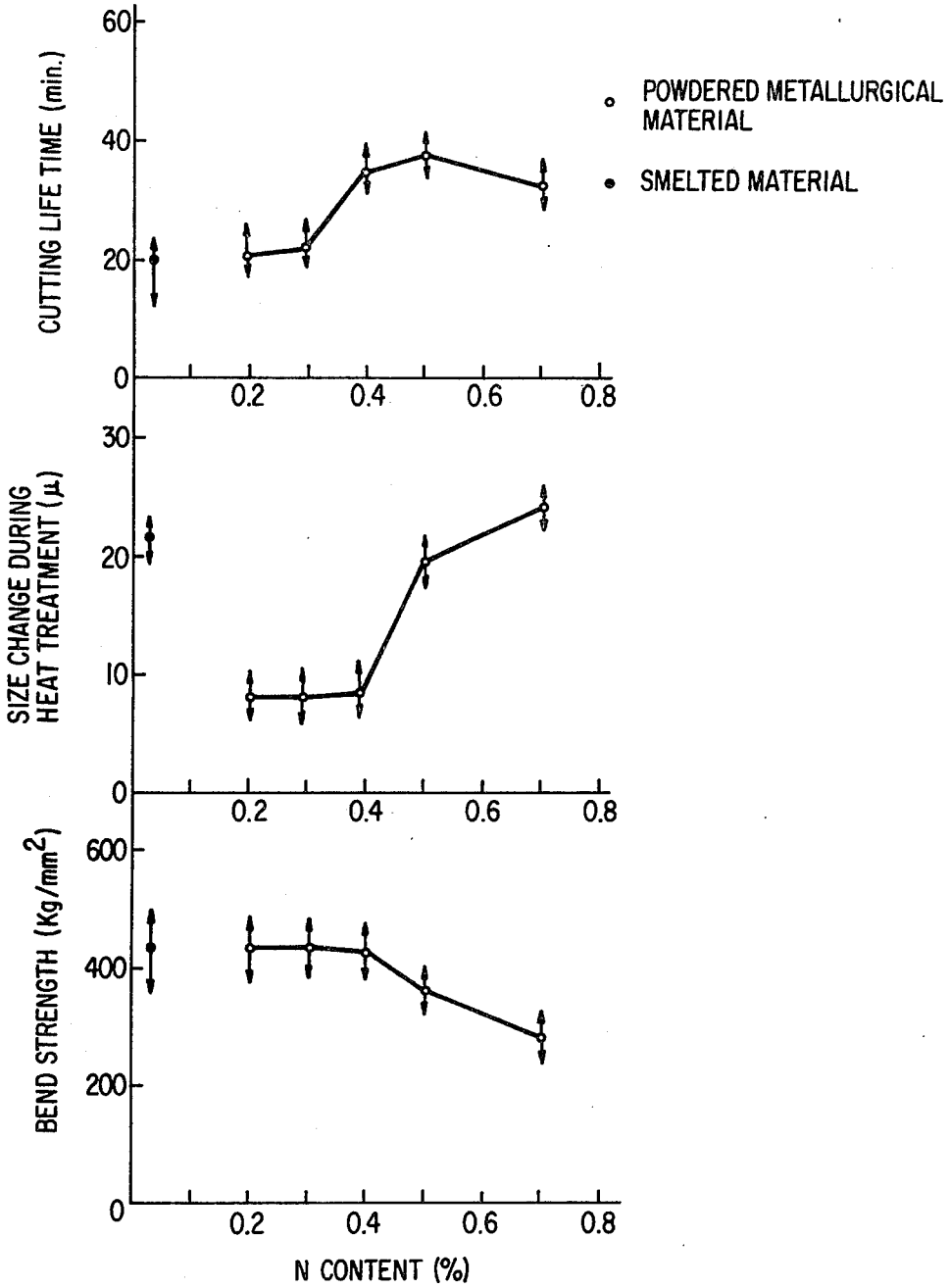
FIG. 1 is a graph illustrating the relationship of the nitrogen content in high speed steels to the cutting life time, the size change during heat treatment and the bending strength.

As will be apparent from the results shown in FIG. 1, the machinability is remarkably improved when the nitrogen content is at least 0.40% and a maximum value is obtained when the nitrogen content is about 0.5%. The heat treatment strain is lower and better than in steels prepared by the melting process when the nitrogen content is lower than 0.40%. However if the nitrogen content exceeds 0.40%, the heat treatment strain is increased to a level substantially equal to the size change during heat treatment in steels obtained by the smelting process. Further, a better bend strength is obtained when the nitrogen content is lower than 0.40%, but the bend strength apparently diminishes if the nitrogen content exceeds 0.40%. Namely, the machinability cannot be improved if the nitrogen content does not exceed 0.40%. On the other hand, no better results are obtained in connection with the size change during heat treatment and bend strength if the nitrogen content is not lower than 0.40%. In short, a nitrogen content giving a better machinability adversely affects the heat treatment characteristic and traverse bending strength of the steel.

Carbon which is an essential element of high speed steels has general properties quite similar to those of nitrogen which is an additive element. Each of these elements has a very small atomic number of 6 or 7 and is an atom of the interstitial type having a tendency to readily form an alloy compound. Accordingly, in high speed steels having a high nitrogen content, it is deemed rather reasonable to adjust or regulate the nitrogen content in combination with the carbon content, for example, relying on such factors as the (C + N) content and the C/N ratio, than to adjust or regulate the nitrogen content irrespective of the carbon content only. Moreover, it is desired to regulate or adjust the nitrogen content after due consideration of the contents of elements which have been admitted in the art as elements capable of forming carbides together with C and N in high speed steels, especially vanadium.

In view of the foregoing, as illustrated in the Examples hereinafter, steel powders corresponding to JIS SKH 9 or 10, which differ in carbon content, were prepared and nitrogen was incorporated in these steel powders in an amount greater than 0.35%, which is a critical level necessary for improving the machinability. Then, high speed steels were prepared from these powders by the powder metallurgical process, and they were tested with respect to the machinability, the heat treatment strain and the traverse bending strength and the results obtained are shown in FIGS. 2 to 4.

Figure 2:
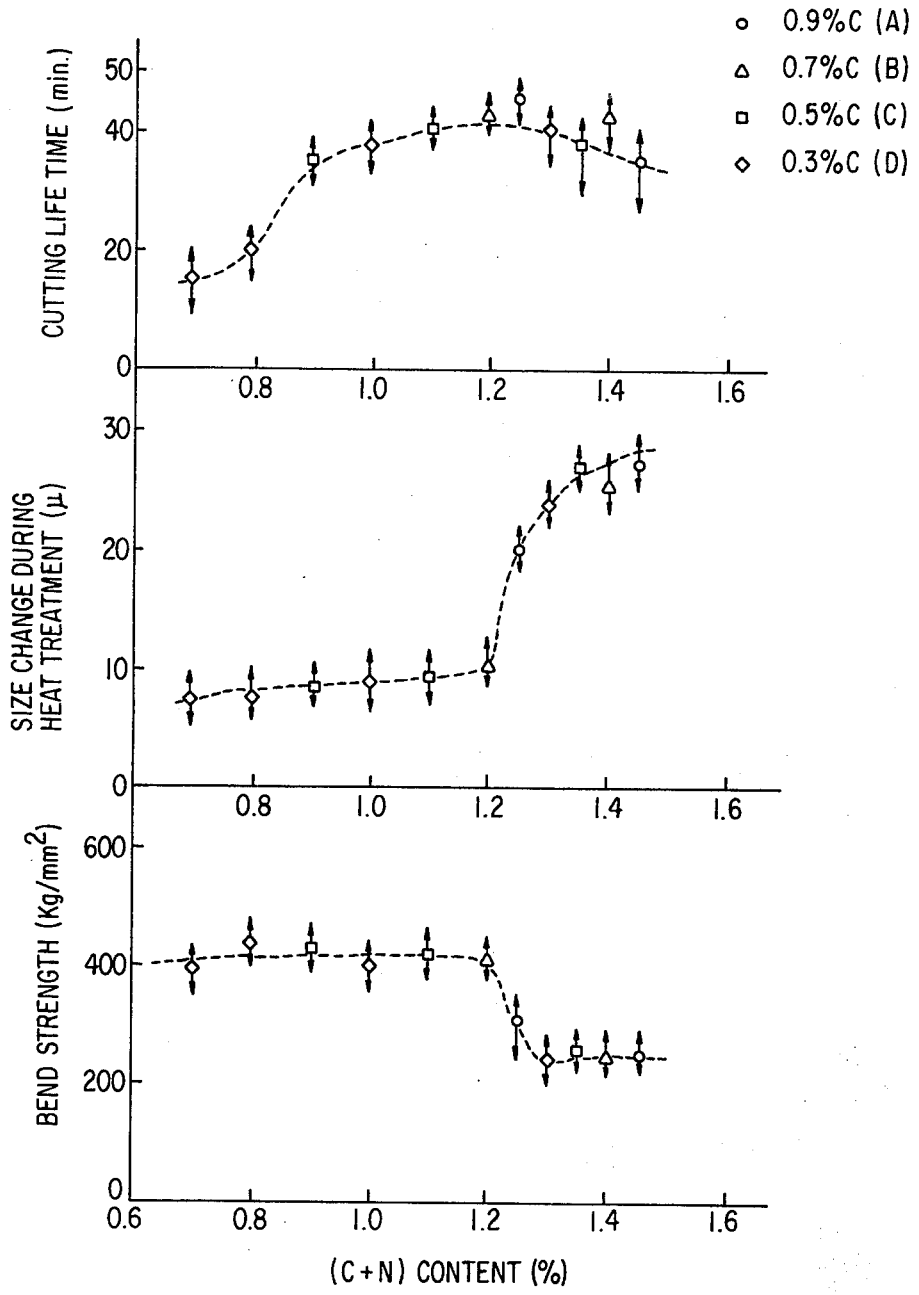
FIG. 2 is a graph illustrating the relationship of the content of high speed steels versus the cutting life time, the size change during heat treatment and the bending strength.

FIG. 2 illustrates the results obtained with respect to steels corresponding to SKH 9 (V = 1.95 to 2.04%). It is seen from FIG. 2 that if the (C + N) content is higher than 0.9%, the machinability is remarkably improved and either the size change during heat treatment or the bend strength is maintained at a desirable level when the (C + N) content is less than 1.2%. Namely, in a nitrogen containing high speed steel obtained by the powder metallurgical process, which corresponds to JIS SKH 9, a suitable range of the (C + N) content for improving the machinability without degradation of the heat treatment characteristic and mechanical properties is from 0.9% to 1.2%.

Figure 3:
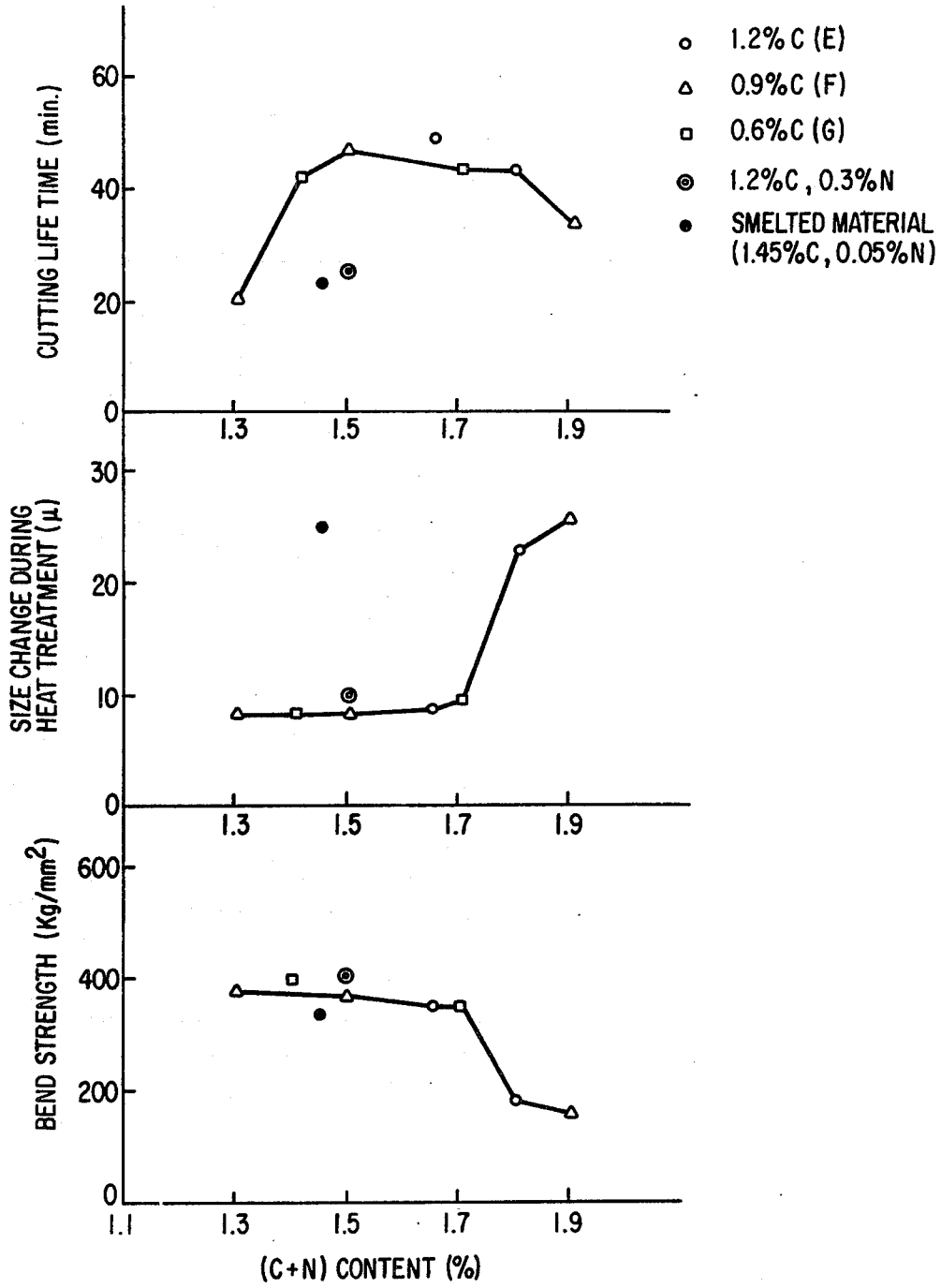
FIG. 3 is a graph illustrating the relationship of the (C + N) content of high speed steels versus the cutting life time, the size change during heat treatment and the bending strength.

FIG. 3 illustrates the results obtained with respect to steels corresponding to SKH 10 (V = 4.45 to 4.53%). From FIG. 3, it is apparent that a suitable range of the (C + N) content is from 1.4% to 1.7%.

Figure 4:
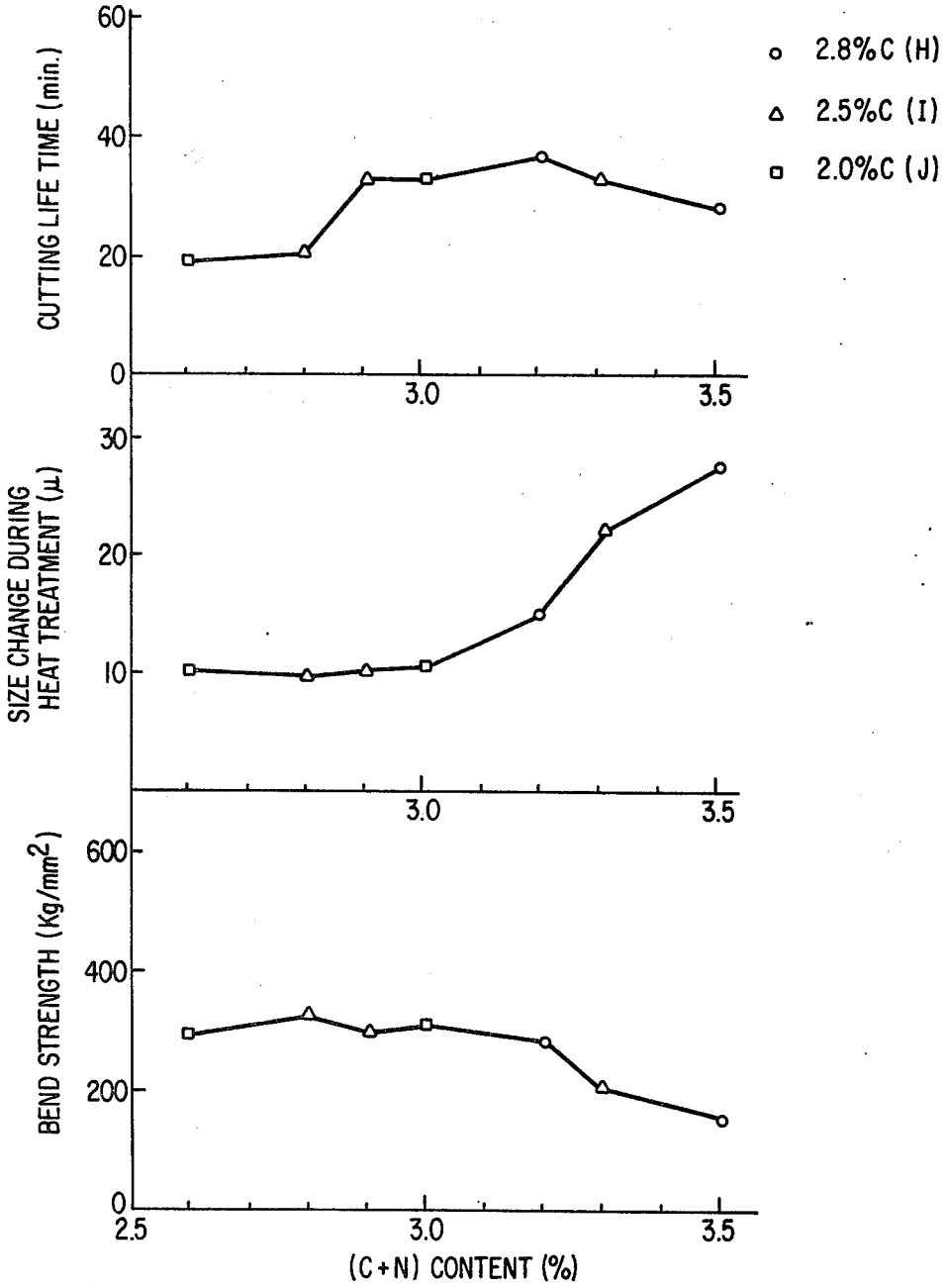
FIG. 4 is a graph illustrating the relationship of the (C + N) content of high speed steels versus the cutting life time, the size change during heat treatment and the bend strength.

FIG. 4 illustrates the results obtained with respect to steels having an increased V content, namely 4%Cr-3.5%Mo-10%W-12%V steels. In this case, a suitable range of (C + N) content is from 2.9% to 3.2%.

If the foregoing experimental results obtained with respect to various high speed steels obtained by the powder metallurgical process are collectively considered mainly in view of the (C + N) and V contents, it is apparent that in order to improve the machinability of the steel without degradation of the heat treatment characteristic and the traverse bending strength, the following requirement must be satisfied:

$$0.5 + 0.2V\ (\%) \leqq (C + N) \leqq 0.8 + 0.2V\ (\%)$$

If the V content exceeds 15%, the toughness ordinarily decreases drastically because a vanadium type carbonitride is coarsened, and in such case, the above relationship which defines a range of (C+ N) content suitable for machinability, the heat treatment characteristics and the mechanical properties are not satisfied. Moreover, if the vanadium content is higher than 15%, since a vanadium type carbonitride is coarsened, the gridability and forging property are degraded very substantially. If the V content is lower than 1.6%, it is substantially difficult to include at least 0.4% of N in the form of a nitride. Of course, even in such a case, enrichment of N can be accomplished if the nitriding pressure is made higher than the atmospheric pressure. However, in this case, nitrides of Cr, Fe and the like are formed, resulting in remarkable reduction of the machinability and traverse bending strength. Therefore, in the present invention, the lower limit of the V content is defined as 1.6%. In high speed steels, a higher wear resistance is obtained as the amount of a carbonitride of the MX type comprising V as the main alloy element, which is hardest among carbonitrides, is larger. Therefore, in the present invention, in order to enhance the effect by addition of N, it is preferred that the V content be at least 2.5%. No significant improvement of the machinability is attained if the nitrogen content is lower than 0.40%. In the present invention, it is preferred that the nitrogen content be at least 0.45%.

As will be apparent from the foregoing experimental results, the above-mentioned relationship, namely an appropriate range of the (C + N) content, is not changed in various high speed steels differing in the content of such metals as Cr, Mo, W and Co. In general, in high speed steels, Cr is added in an amount of up to 15%, Mo is added in an amount of up to 10%, W is added in an amount of up to 20% and Co is added in an amount of up to 15%. Further, according to need, up to 2% of Zr, up to 5% of Nb and up to 1% of B may be added. The function of the additive elements will now be described.

W is an element improvement for imparting the required properties to high speed steels. It combines with C, N and Fe to form a nitride of the $M_6X$ type and is dissolved in the substrate to improve the temper hardening property and the high temperature hardness and thereby enhance the wear resistance. Therefore, W makes a great contribution to the improvement of the machinability of the steel. However, if the W content exceeds 20%, no substantial increase of such effects is attained. Therefore, in the present invention, W is incorporated in an amount of up to 20%. In high speed steels, Mo exerts effects similar to those of W, but Mo is different from W from the point that it inhibits the growth of the crystal grain and it does not greatly reduce the toughness. If the Mo content exceeds 10%, however, these effects are not substantially attained but the hot workability is degraded. Accordingly, Mo is incorporated in an amount of up to 10%. Cr is present in the substrate and carbonitrides and improves the quenching property and enhances the temper hardening property and high temperature hardness. However, if the Cr content exceeds 15%, the residual austenite content is drastically increased. Accordingly, Cr is incorporated in an amount of up to 15%. When Co is used in combination with W, Mo, V and the like, it efficiently improves the high temperature hardness and it is an additive element important for a tool steel for hard cutting materials. However, if the Cr content exceeds 15%, the quenching property and hot workability are degraded. Accordingly, Cr is incorporated in an amount of up to 15%. Among impurities, Al is not preferred. The reason is the Al is present in the form of AlN which reduces the effects of N. Accordingly, it is necessary to reduce the Al content below 0.4%.

The present invention will now be described by reference to the following Examples.

EXAMPLE 1

Gas-atomized steel powders corresponding to JIS SKH 9 and differing in carbon content were packed in mild steel cans, subjected to degasification and nitriding treatments and then compression-formed by a hot isostatic press to obtain steel ingots. Products were obtained by subjecting these ingots to a heat treatment. The preparation conditions and the tests for determining the machinability, size change during heat treatment and traverse bending strength are illustrated below. For comparison, products prepared by subjecting steels obtained by the smelting process to a heat treatment were similarly tested, and the results are described below.

(1) PREPARATION CONDITIONS

(a) Chemical Composition and Grain Size of Starting Powder:

The starting powders used are shown in Table 1.

Table 1

| Kind of Steel | Composition (%) | | | | | | | | | | | |
|---|---|---|---|---|---|---|---|---|---|---|---|---|
| | C | Si | Mn | P | S | Cr | Mo | W | V | O | N | Grain Size |
| A(0.9% C) | 0.91 | 0.30 | 0.30 | 0.01 | 0.03 | 4.15 | 4.91 | 6.03 | 1.98 | 0.025 | 0.025 | smaller than 80 mesh |
| B(0.7% C) | 0.70 | 0.29 | 0.27 | 0.01 | 0.03 | 4.30 | 5.01 | 6.12 | 1.95 | 0.010 | 0.021 | " |
| C(0.5% C) | 0.49 | 0.25 | 0.24 | 0.01 | 0.04 | 4.35 | 5.12 | 6.06 | 2.00 | 0.030 | 0.015 | " |
| D(0.3% C) | 0.32 | 0.31 | 0.32 | 0.01 | 0.03 | 4.11 | 4.97 | 6.15 | 2.04 | 0.035 | 0.018 | " |

(b) Nitriding Treatment

The nitriding treatment was conducted at 1150° C. for 2 hours in a nitrogen atmosphere. The pressure of the atmosphere ws appropriately controlled to adjust the nitrogen content in the product.

(c) Hot Isostatic Press Treatment

The treatment was conducted at 1100° C. for 2 hours under 2000 atmospheres.

(d) Heat Treatment

Hardening: 1200° C. × 3 minutes (oil quenching)
Tempering: repeated 2 to 4 times with a heating pattern of 560° C. × 1.5 hours In case of comparative steels obtained by the melting process, the oil quenching was conducted at 1200° C. for 3 minutes and the tempering was repeated 2 times with a heating pattern of 560° C. × 1.5 hours.

(2) TEST CONDITIONS

(a) Machinability Test

Cutting speed: 30 m/min
Cut depth: 1.5 mm
Feed rate: 0.2 mm/revolution
Cutting oil: not used
Tool shape: 0°, 15°, 6°, 6°, 15°, 15°, 1.0
Material machined: JIS SCM 4 (quenched and tempered), $H_B$ of 250 - 270, 4 slots

(b) Heat Treatment Strain

A non-heat treated material having a diameter of 80 mm and a height of 100 mm was used as the specimen, and after the heat treatment, the size change from the circle (maximum diameter — minimum diameter) was measured.

(c) Traverse Bending Strength

A specimen of 5 mm × 10 mm × 30 mm was subjected to the static bending test in which the distance between fulcra was 20 mm and the load was imposed on the center alone.

(3) RESULTS OF TESTS

Test results are shown in FIG. 2. As is apparent from the results shown in FIG. 2, in nitrogen containing high speed steels containing about 4.5% vanadium, obtained by the powder metallurgical process, in order to improve the machinability without degradation of the heat treatment characteristic and the traverse bending strength, the nitrogen content must be at least 0.4%, preferably at least 0.45%, and an appropriate (C + N) content is in the range of 0.9 to 1.2%.

If the nitrogen content is lower than 0.4%, a sufficient nitriding effect cannot be obtained, and if the (C + N) content is lower than 0.9%, the amount of precipitated nitrides is small and the wear resistance is degraded. if the (C + N) content exceeds 1.2%, the residual austenite content is increased at the hardening step and its amount becomes unstable. Therefore, the size change during heat treatment becomes conspicuous and the bend strength is lowered.

EXAMPLE 2

Atomized steel powders corresponding to JIS SKH 10 and differing in carbon content as shown in Table 2 were used as the starting powders and prepared into nitrogen containing high speed steels by the powder metallurgical process in the same manner as described in Example 1. The machinability, size change during heat treatment and bend strength were tested and the results obtained are shown in FIG. 3.

Table 2

| Kind of Steel | Composition (%) | | | | | | | | | | | |
|---|---|---|---|---|---|---|---|---|---|---|---|---|
| | C | Si | Mn | P | S | Cr | W | V | Co | O | N | Grain Size |
| E(1.2% C) | 1.20 | 0.21 | 0.31 | 0.01 | 0.02 | 4.05 | 11.9 | 4.45 | 4.61 | 0.030 | 0.050 | smaller than 28 mesh |
| F(0.9% C) | 0.91 | 0.25 | 0.25 | 0.02 | 0.03 | 3.91 | 12.3 | 4.53 | 4.85 | 0.035 | 0.031 | " |
| G(0.6% C) | 0.59 | 0.31 | 0.29 | 0.01 | 0.03 | 4.12 | 12.8 | 4.48 | 4.92 | 0.021 | 0.063 | " |

As is apparent from the results shown in FIG. 3, *a* (C+ N) content effective for improving the machinability without degradation of the heat treatment characteristic and bend strength is in the range of from 1.4 to 1.7%. FIG. 3 also indicates that even in nitrogen containing high speed steels obtained by the powder metallurgical process, even if the (C + N) content is in the range of 1.4 ~ 1.7 %, when N is added in a small amount as about 0.3%, no substantial improvement of the machinability can be attained.

EXAMPLE 3

Gas-atomized steel powders containing 12% vanadium and differing in carbon content as shown in Table 3 were used as the starting powders and prepared into nitrogen containing high speed steels by the powder metallurgical process in the same manner as described in Example 1. The machinability, size change during heat treatment and bend strength were tested and the results obtained are shown in FIG. 4.

Table 4

| Kind of Steel | Composition (%) | | | | | | | | | | | |
|---|---|---|---|---|---|---|---|---|---|---|---|---|
| | C | Si | Mn | P | S | Cr | Mo | W | V | O | N | Grain Size |
| H(2.8% C) | 2.81 | 0.28 | 0.30 | 0.01 | 0.02 | 4.05 | 3.51 | 10.5 | 12.1 | 0.035 | 0.15 | smaller than 80 mesh |
| I(2.5% C) | 2.50 | 0.29 | 0.31 | 0.01 | 0.02 | 4.01 | 3.56 | 10.3 | 12.2 | 0.041 | 0.18 | " |
| J(2.0% C) | 2.01 | 0.29 | 0.30 | 0.01 | 0.02 | 4.04 | 3.61 | 9.8 | 12.3 | 0.030 | 0.18 | " |

As will be apparent from the results shown in FIG. 4, a (C + N) content effective for improving the machinability without degradation of the heat treatment characteristic and bend strength of steel is in the range of from 2.9 to 3.2%.

As is readily apparent from the foregoing illustration, in the nitrogen containing high speed steel obtained by the powder metallurgical process according to the present invention, the machinability, heat treatment characteristics and mechanical properties can be remarkably improved by adjusting and controlling the contents of carbon, nitrogen and vanadium so that the following requirements are satisfied:

$N \geqq 0.40\%$, $1.6\% \leqq V \leqq 15\%$, and $0.5 + 0.2V\ (\%) \leqq (C + N) \leqq 0.8 + 0.2V\ (\%)$.

What is claimed as new and intended to be secured by letters Patent is:

1. A nitrogen containing high speed steel which comprises, after being formed by powder metallurgical processing, at least 0.40% of N, 1.6 to 15% of V, C in an amount satisfying the relation of $0.5 + 0.2\ V\ (\%) \leqq (C + N) \leqq 0.8 + 0.2V\ (\%)$ and at least one member selected from the group consisting of up to 15% of Cr, up to 10% of Mo, up to 20% of W and up to 15% of Co.

2. The nitrogen containing high speed steel as set forth in claim 1, wherein the content of N is at least 0.45 %.

3. The nitrogen containing high speed steel as set forth in claim 1, wherein the content of V is 2.5 to 15%.

4. The nitrogen containing high speed steel as set forth in claim 1, which further comprises at least one element selected from the group consisting of up to 2% to Zr, up to 5% of Nb and up to 1% of B.

* * * * *

UNITED STATES PATENT AND TRADEMARK OFFICE

CERTIFICATE OF CORRECTION

PATENT NO. : 4,121,930
DATED : October 24, 1978
INVENTOR(S) : Yukawa et al.

It is certified that error appears in the above-identified patent and that said Letters Patent are hereby corrected as shown below:

Column 3, line 12, before "content", insert (C + N); line 22, change "bend" to --bending--; line 39, change "traverse" to --transverse--; line 62, change "traverse" to --transverse--.

Column 4, line 22, change "traverse" to --transverse--; line 52, change "traverse" to --transverse--; line 64, change "gridability" to --grindability--.

Column 5, line 4, change "traverse" to --transverse--; line 68, change "the" to --that--.

Column 6, line 15, change "traverse" to --transverse--.

Column 7, line 3, change "Traverse" to --Transverse--; line 21, change "4.5%" to --2%--.

Column 8, line 63, before "Zr", change "to" to --of--.

Signed and Sealed this

*Fourth* Day of *March 1980*

[SEAL]

*Attest:*

SIDNEY A. DIAMOND

*Attesting Officer*

*Commissioner of Patents and Trademarks*